US005176218A

United States Patent [19]

Singer et al.

[11] Patent Number: 5,176,218

[45] Date of Patent: Jan. 5, 1993

[54] ADJUSTABLE MANDREL WELL CASING HANGER

[75] Inventors: Roy E. Singer; Richard C. Lalor, both of Tomball; Kenneth G. Rountree; Marcus A. Smedley, both of Houston, all of Tex.; John H. Miller, Youngsville, La.

[73] Assignee: FMC Corporation, Chicago, Ill.

[21] Appl. No.: 708,641

[22] Filed: May 31, 1991

[51] Int. Cl.[5] ..... E21B 33/043

[52] U.S. Cl. ..... 166/206; 166/382

[58] Field of Search ..... 166/208, 381, 382, 206

[56] References Cited

U.S. PATENT DOCUMENTS 4,562,889 1/1986 Braddick ..... 166/208 X
4,653,589 3/1987 Alandy ..... 166/382
4,794,988 1/1989 Van Bilderbeek ..... 166/345
4,807,705 2/1989 Henderson et al. ..... 166/208 X
4,823,871 4/1989 McEver et al. ..... 166/208 X
4,938,289 7/1990 Van Bilderbeek ..... 166/342

FOREIGN PATENT DOCUMENTS 2211542 7/1989 United Kingdom .

*Primary Examiner*—Thuy M. Bui
*Attorney, Agent, or Firm*—Richard B. Megley; William W. Ritt, Jr.

[57] ABSTRACT

A three-component adjustable mandrel well casing hanger that can be attached to the upper end of a tie-back sub or string to effect a tensioned connection between a subsea location and a surface wellhead of an offshore well.

10 Claims, 3 Drawing Sheets

ADJUSTABLE MANDREL WELL CASING HANGER

BACKGROUND OF THE INVENTION

This invention relates to well casing hangers, and more particularly to adjustable mandrel casing hangers for use with mudline tie-back apparatus.

One of the procedures of the petroleum industry to complete wells drilled at offshore locations is to use a tie-back sub or string to connect the upper end of the casing at the mudline to a surface-located wellhead. Because of the difficulty in spacing out long tie-back casing strings the surface casing hanger assembly must be able to adjust up or down a substantial distance, for example, forty-eight inches, be able to support a large tension load weight of, for example, 300,000 pounds in addition to the casing string weight, and maintain a reasonable height of the surface wellhead without having to machine the excess casing or hanger to the correct length.

Prior to the present invention three different methods were employed to overcome these subsea tie-back problems. The first was to adjust the casing hanger up or down, and then cut the hanger or casing to the proper length. Although this method works, it is very expensive due to the amount of rig time that it wastes. The second method was to make the surface wellhead large enough to swallow the entire hanger or casing plus the packoff. This works well for small adjustments, such as two to four inches, but becomes very cost prohibitive and space limiting when the needed adjustment grows to forty-eight inches. The third method was to move the entire wellhead up or down as required, but this is very expensive and requires the rig to have unlimited height capability, so that this method is not very effective.

SUMMARY OF THE INVENTION

The foregoing and other problems are solved in a less time consuming and otherwise less costly manner by the present invention, which invention comprises a three-component adjustable mandrel casing hanger assembly that can be attached to the upper end of a tie-back sub or string to effect a tensioned connection between the mudline and a surface located wellhead of an offshore well. The components of this assembly comprise an elongated threaded tubular mandrel, a hanger body with threads that mate with the mandrel threads, and a variable length hanger neck that connects to the upper end of the hanger body. The mandrel has an external annular load shoulder that seats on an internal annular shoulder in the wellhead to support the casing weight and the tension load, and the threads interconnecting the mandrel and hanger body facilitate axial adjustment of the mandrel to accomplish that seating. The variable length hanger neck facilitates extension of the hanger body to a position above the mandrel where a packoff can be installed to provide a seal of the annulus between the hanger and the wellhead, regardless of the actual position of the hanger body with respect to the wellhead.

The hanger body/mandrel sub-assembly is run and installed in the wellhead by a mandrel running tool that is threadedly connected to the hanger body, and separately connected to the mandrel by a hydraulic motor sub-assembly, or if desired by a straight mechanical type tool, for rotating the mandrel with respect to the stationary hanger. Once the tie-back connection has been tested, the required tension load is pulled through the running tool and the mandrel then rotated to thread it downward with respect to the hanger body until it seats on the wellhead shoulder. This running tool is then removed, and a hanger neck of appropriate length is then run and installed in the hanger body to prepare for installation of the hanger/wellhead packoff.

DESCRIPTION OF THE PREFERRED EMBODIMENT

Figure 1:
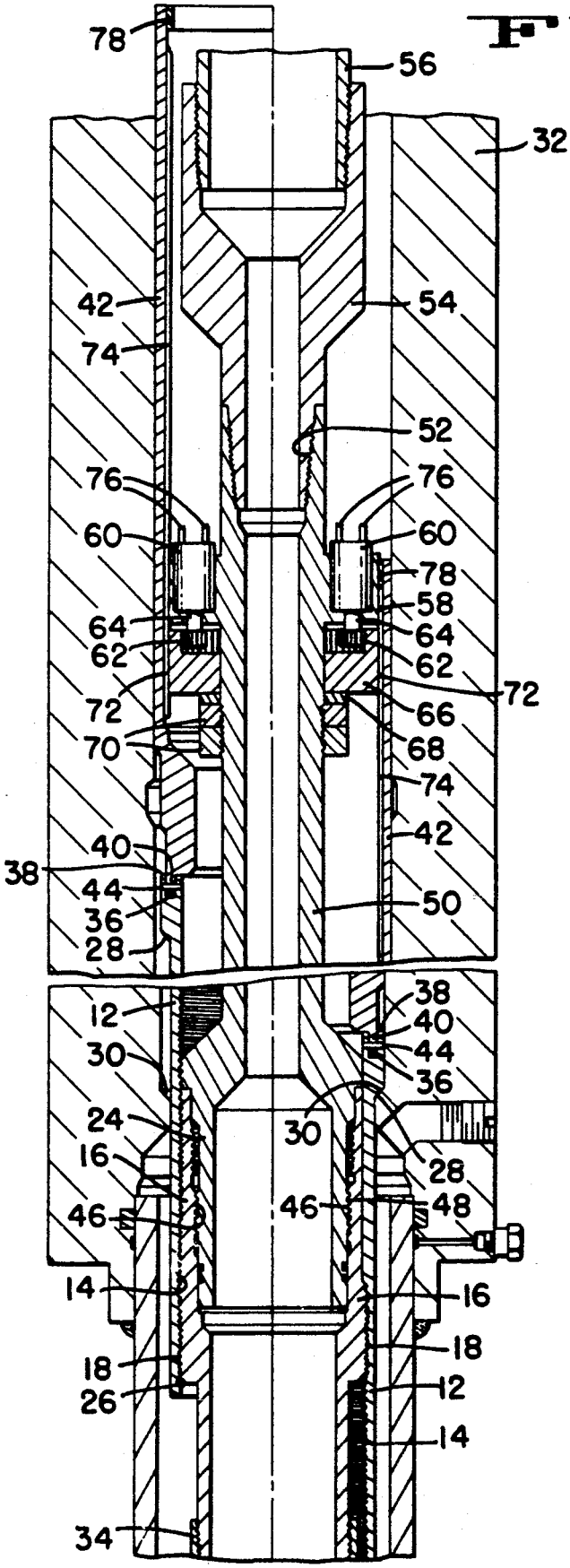
FIG. 1 is a central vertical section through a hanger body/mandrel sub-assembly, and a running tool for that sub-assembly, in a wellhead according to the present invention, showing on the left of the center line the running position of the sub-assembly components, and on the right of the center line the landed position of those components.

As illustrated in the drawings, an adjustable mandrel casing hanger according to the present invention comprises an elongated tubular mandrel 12 with internal threads 14, a hanger body 16 with external threads 18 that mate with the mandrel threads 14 to rotatably connect the body to the mandrel, and a variable length hanger neck 20 (FIG. 2) with external threads 22 that mate with internal right hand threads 24 in the upper end of the hanger body 16 to interconnect the neck and body.

Figure 2:
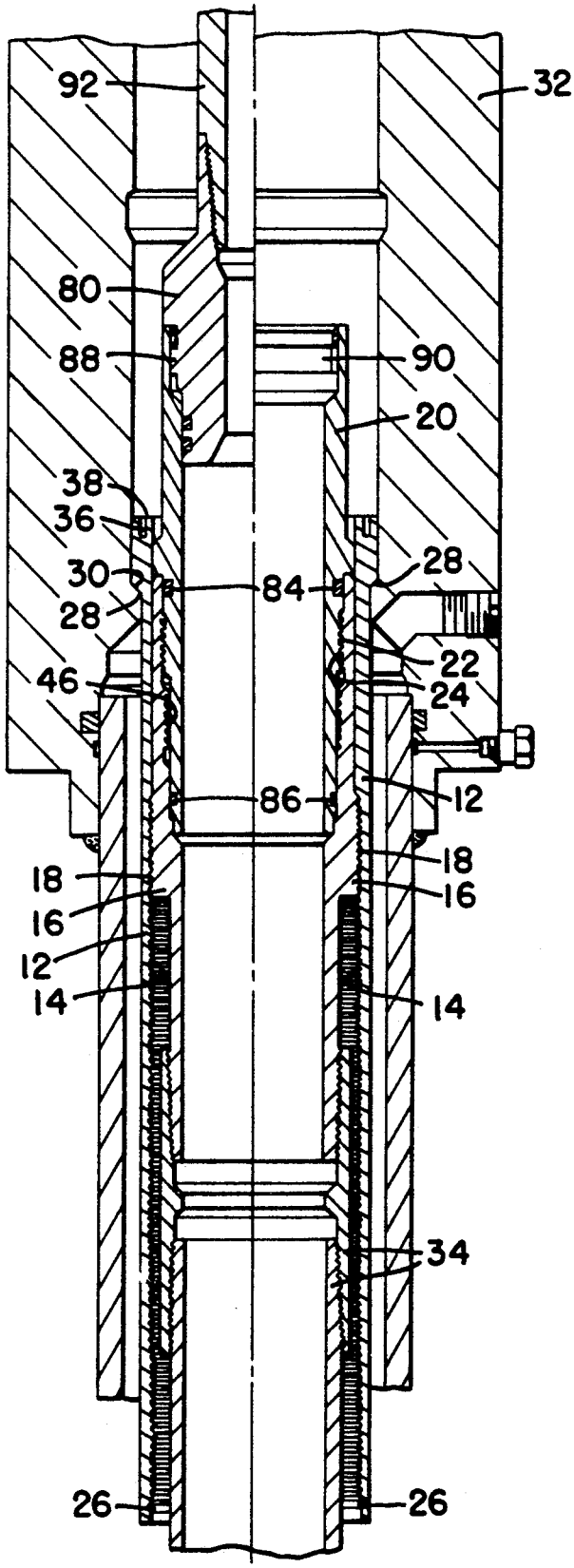
FIG. 2 is a view like FIG. 1, showing the hanger body and mandrel in landed position, a hanger neck installed, and the hanger neck running tool on the left of the center line.
Figure 3:
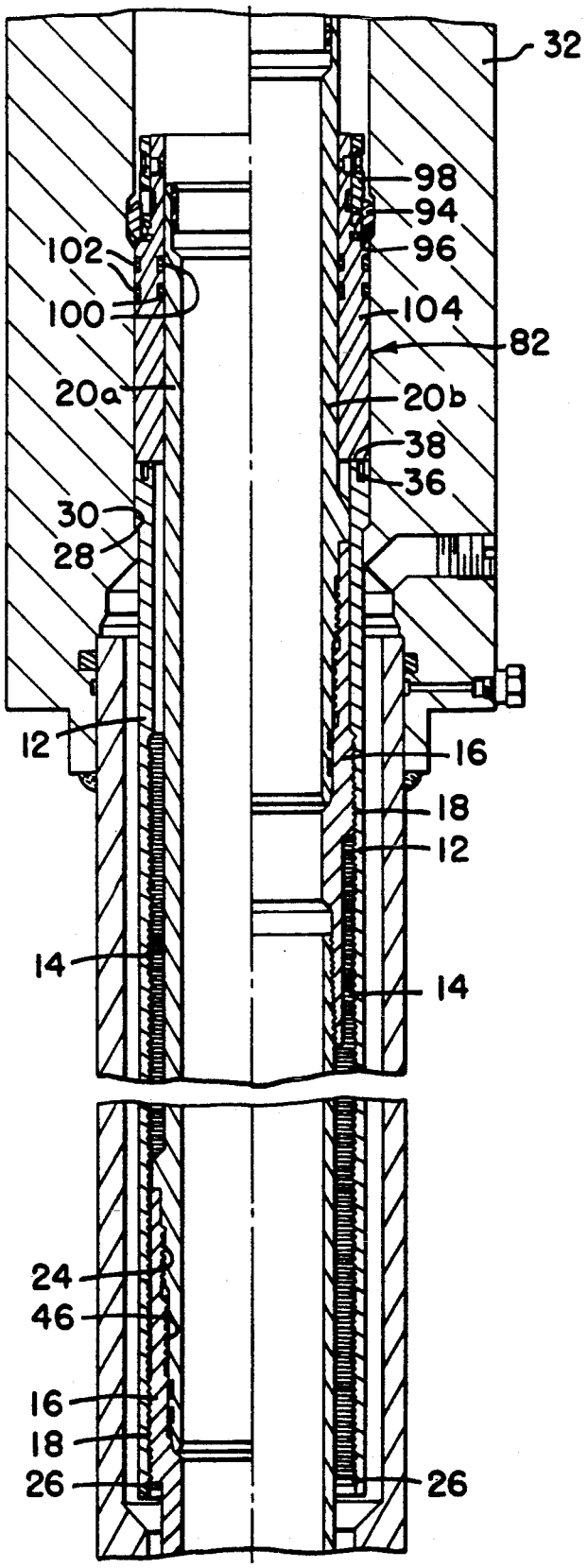
FIG. 3 is a view like FIG. 2 showing, on opposite sides of the center line, the hanger body at its lowest and highest positions in the mandrel, relatively long and short length hanger necks, and a packoff assembly installed above the mandrel and between the wellhead and adjacent hanger neck.

As seen best in FIGS. 2 and 3, the mandrel threads 14 extend from near the upper end of the mandrel to its lower end to facilitate maximum vertical adjustment of the mandrel on the hanger body 16, and a snap ring 26 at the lower end of the threads 14 functions as a stop to prevent accidental separation of the mandrel from the hanger body. The upper end portion of the mandrel 12 is of enlarged outer diameter to provide an outer downwardly-facing annular shoulder 28 of frusto-conical configuration that seats upon an inner upwardly-facing annular shoulder 30 of a wellhead 32 when the mandrel is landed (FIGS. 2 and 3, and right half of FIG. 1), the shoulders 28, 30 thereby cooperating to support the weight of the hanger body 16, the casing 34 connected to and suspended from the hanger body, and also the casing tension load created during the installation procedure. The mandrel 12 also contains a pair of 180 degree spaced axial slots 36 extending downward from its upper end surface 38 for cooperation with finger-like lugs 40 on a hanger running tool sleeve 42 to connect the sleeve to the mandrel, and shear pins 44 secure this connection until sheared during retrieval of the running tool.

The hanger body 16 has a second set of internal threads 46, spaced below the threads 24 and of left hand configuration, that cooperate with mating external threads 48 on a tubular running tool body 50 to releasably connect the tool body to the hanger body. The tool body 50 has upper internal threads 52 for connecting it to an adapter 54 of suitable length to join the tool to a pipe string 56 that is used for running the tool and hanger assembly, landing the hanger assembly in the wellhead 32, and then retrieving the tool for repeated use.

The running tool body 50 has an outward extending radial flange 58 that serves as a support for a plurality of hydraulic motors 60 (only two shown) circumferentially spaced in the flange, and each motor includes a pinion gear 62 on a downward oriented shaft 64. Below the flange 58 is a ring gear 66 rotatably surrounding and supported on the running tool body 50 by an annular bushing 68 and a lock nut pair 70. The ring gear 66 has a pair of 180 degree spaced axial slots 72 in its outer surface that cooperate with a pair of axial keys 74 on the inner surface of the running tool sleeve 42 to interconnect the ring gear and sleeve in a manner that prevents their relative rotation but facilitates their relative axial movement. Therefore, when the hydraulic motors 60 are activated through hydraulic lines 76 the pinion gears 62 rotate, thereby rotating the ring gear 66 together with the running tool sleeve 42 and the mandrel 12. As the mandrel 12 rotates the threads 18 cause it and the running tool sleeve 42 to descend with respect to the hanger body 16 until the mandrel shoulder 28 lands and seats on the wellhead shoulder 30, at which position the hanger body 16, the weight of the casing 34, and the casing tension load which has previously been created by upward pull on the running string 56, are fully supported by the wellhead 32. A stop 78 in the upper end of the running tool sleeve 42 prevents the sleeve from descending beyond a predetermined limit with respect to the running tool body flange 58.

After landing the hanger mandrel 12 in the wellhead as explained above, the rig tension exerted on the running string 56 is slacked off and the string is rotated to the right, thereby rotating the running tool body 50 and unthreading it from the hanger body 16. The running string 56 is then lifted to fracture the shear pins 44 and release the tool sleeve 42 from the hanger mandrel 12, whereby the entire running tool assembly can then be retrieved by further lifting of the running string.

With the adjustable mandrel hanger landed in the wellhead 32, and the hanger running tool assembly removed (FIG. 2), a tubular hanger neck 20 of appropriate length, releasably connected to a neck running tool 80, is then run into the hanger body 16 and rotated to the right to make up the threads 22, 24 and connect the neck to the body. The length of the hanger neck will depend in part on the location of the hanger body with respect to the top of the mandrel 12, and also in part on the axial length of a packoff 82 (FIG. 3) that is to be installed to seal the annulus between the hanger body/-hanger neck and the surrounding wellhead 32. If the hanger body 16 resides at the lower end of the mandrel 12 after installation (FIG. 3), the hanger neck 20*a* will be much longer than the hanger neck 20*b* which is used when the hanger body is at the top of the mandrel 12. Annular seals 84, 86 provide a pressure-tight connection between the hanger neck 20 and hanger body 16, so that the packoff 82 (FIG. 3) effectively seals the annulus between the wellhead 32 and the hanger body/hanger neck. The neck running tool 80 has anti-rotation lugs 88 that fit into a matching annular groove 90 in the hanger neck 20, so that once the hanger neck is torqued into the hanger body 16 the running tool 80 can be removed by rotating it to the right and pulling up on its running string 92.

Following removal of the hanger neck running tool 80, the annular packoff 82 is installed by means of a running tool and string (neither shown) and locked to the wellhead 32 by expanding a split lock ring 94 into a wellhead groove 96 with an expander mandrel 98, all in a known manner. Inner and outer seals 100, 102 provide a pressure seal between the packoff body 104 and the hanger neck 20*a*/20*b*, and between the body 104 and the wellhead 32, respectively, to complete this phase of the tie-back operation.

As should now be understood, an adjustable mandrel casing hanger according to the present invention supports the casing weight and required casing tension load, and provides sufficient axial adjustment to eliminate the necessity of parting or machining the casing at the rig floor or split the wellhead. Furthermore, when using an adjustable mandrel casing hanger embodying the features of the present invention, the operator merely needs to rotate to the right or left to connect-/disconnect into the subsea tie-back sub, land the hanger mandrel, and thread the variable length hanger neck into the adjustable hanger body.

Although the best mode contemplated for carrying out the present invention has been herein shown and described, it will be apparent that modification and variation may be made without departing from what is regarded to be the subject matter of the invention.

What is claimed is:

1. An adjustable mandrel hanger for supporting a pipe in a wellhead, said hanger comprising an assembly including a) an elongated tubular mandrel having upper and lower ends, a set of internal threads and an external annular shoulder for supporting said assembly in the bore of a wellhead component;

b) a tubular hanger body having external threads that mate with the internal threads of the mandrel to interconnect said body and mandrel, and means to connect said body to a pipe to run the assembly into a wellhead; and c) a hanger neck connectable to the hanger body for extending said body beyond the upper end of the mandrel to a position for cooperation with an annular sealing means to seal an annulus between the hanger assembly and said wellhead component.

2. A hanger assembly according to claim 1 wherein the hanger body has a first set of internal threads for connecting said hanger body to the hanger neck.

3. A hanger assembly according to claim 2 wherein the means to connect the hanger body to a pipe comprises a second set of internal threads of opposite hand with respect to said first thread set.

4. A hanger assembly according to claim 1 wherein the mandrel includes means to connect a rotatable power means to said mandrel for rotating said mandrel with respect to the hanger body.

5. A hanger assembly according to claim 4 wherein rotation of the mandrel results in axial movement of the mandrel with respect to the hanger body.

6. A hanger assembly according to claim 4 wherein the means to connect a rotatable power means to the mandrel comprises a plurality of axial slots in the upper end of the mandrel that accept a plurality of finger-like lugs on the power means.

7. A hanger assembly according to claim 1 wherein the hanger neck includes external threads that mate with the hanger body first thread set, and means to releasably connect said hanger neck to a running tool for running said neck into the hanger body.

8. A hanger assembly according to claim 1 wherein the hanger neck is of variable length depending upon the location of the hanger body with respect to the upper end of the mandrel when said mandrel is seated in the wellhead component.

9. A hanger assembly according to claim 1 including means to run the hanger body and mandrel into the wellhead component, and means to land the mandrel on a wellhead component seat.

10. A hanger assembly according to claim 9 wherein the means to land the mandrel on the wellhead component seat comprises at least one hydraulic power means supported on the means to run the hanger body and mandrel, and means interconnecting the hydraulic power means to the mandrel for causing rotation of said mandrel upon application of hydraulic power to said power means.

* * * * *